US005975526A

United States Patent [19]

Hoffman

[11] Patent Number: 5,975,526

[45] Date of Patent: Nov. 2, 1999

[54] HOCKEY GAME APPARATUS

[76] Inventor: Mark Hoffman, P.O. Box 824, Crosslake, Minn. 56442

[21] Appl. No.: 09/084,577

[22] Filed: May 25, 1998

[51] Int. Cl.[6] ..... A63B 67/04; A63F 7/00

[52] U.S. Cl. ..... 273/108.1; 273/126 R

[58] Field of Search ..... 273/108.1, 108.5, 273/108, 108.51, 108.52, 108.53, 108.54, 108.55, 108.56, 123 R, 126 R, 126 A, 127 R, 119 R, 129 K, 129 L, 317.1–317.9

[56] References Cited

U.S. PATENT DOCUMENTS

| | | |
|---|---|---|
| 513,116 | 1/1894 | Knight . |
| 855,728 | 6/1907 | Pingrey . |
| 1,144,112 | 6/1915 | Denny . |
| 1,593,421 | 7/1926 | Blum . |
| 1,980,274 | 11/1934 | Insall et al. . |
| 2,252,451 | 8/1941 | Anderson . |
| 3,482,837 | 12/1969 | Myers . |
| 3,734,504 | 5/1973 | Breslow . |
| 3,868,111 | 2/1975 | Schuelke . |
| 4,025,073 | 5/1977 | Furr . |
| 4,166,620 | 9/1979 | Sheppard . |
| 4,560,163 | 12/1985 | Erickson . |
| 4,775,152 | 10/1988 | Roehl . |
| 4,877,250 | 10/1989 | Centafanti . |
| 5,382,022 | 1/1995 | Cook . |
| 5,785,615 | 7/1998 | Kosmalski . |
| 5,882,007 | 3/1999 | Gay . |

*Primary Examiner*—Sebastiano Passaniti
*Attorney, Agent, or Firm*—Michael S. Neustel

[57] ABSTRACT

A hockey game apparatus for which combines the physical characteristics of hockey with the strategic characteristics of foosball. The inventive device includes a frame having a floor and a plurality of arcuate walls, a pair of opposing goal openings, and a plurality of partitions having at least one opening. The players each utilize a paddle to engage a ball or disk for scoring a goal in the opposing player's goal opening. The partitions and the arcuate walls preferably include a filler of either foam, water, sand or other sound deadening material. The filler within the partitions reduces the amount of sound emitted from engagement by the paddles. The arcuate walls reduce the chance that the ball or disk will become trapped within a comer during play.

16 Claims, 2 Drawing Sheets

HOCKEY GAME APPARATUS

BACKGROUND OF THE INVENTION

1. Field of the Invention

The present invention relates generally to game devices and more specifically it relates to a hockey game apparatus which combines the physical characteristics of hockey with the strategic characteristics of foosball.

Game devices which simulate the game of hockey have existed for years. A common problem for the prior art game devices is that they are extremely noisy from the player's sticks engaging the side walls and partitions. In addition, the prior art games had no way to introduce the ball or disk onto the playing surface so that neither player had an advantage. Further, the prior art game devices have square corners which tend to trap the ball or disk during play. Hence, it is an object of the present invention to provide a hockey game apparatus which reduces the amount of undesirable noise produced by the player's sticks engaging the side walls and partitions. It is a further object of the present invention to provide a hockey game apparatus which reduces the chance that the ball or disk will become trapped during play.

2. Description of the Prior Art

There are numerous game devices. For example, U.S. Pat. No. 1,593,421 to Blum; U.S. Pat. No. 1,144,112 to Denny; U.S. Pat. No. 4,560,163 to Erickson; U.S. Pat. No. 4,775,152 to Roehl; U.S. Pat. No. 4,166,620 to Sheppard; U.S. Pat. No. 3,868,111 to Schuelke; U.S. Pat. No. 513,116 to Knight; U.S. Pat. No. 1,980,274 to Insall et al. are all illustrative of such prior art.

Blum (U.S. Pat. No. 1,593,421) discloses a game apparatus designed to simulate the game of hockey. Blum teaches game board having a floor, four side walls with two opposing goals, and two partitions with openings within. The players utilize a stick to engage a ball and attempt to score within the opposing player's goal.

Denny (U.S. Pat. No. 1,144,112) discloses a game appliance having a floor, side walls with two opposing goals, and a center partition with a pair of holes. Players utilize hockey sticks to engage a ball attempting to score the ball within the opposing player's goal.

Erickson (U.S. Pat. No. 4,560,163) discloses a hockey game for use with a ball or disk. Erickson teaches a floor, side walls with two opposing goals, and a plurality of partitions with openings within. Players utilize sticks to engage the ball or disk attempting to score within the opposing player's goal.

While these devices may be suitable for the particular purpose to which they address, they are not as suitable for which combines the physical characteristics of hockey with the strategic characteristics of foosball. The prior art devices are extremely noisy when the player's sticks engage the side walls and partitions. Further, the prior art devices have problems with the ball or disk becoming trapped in the corners during play and they are not designed to allow equal advantage to both players.

In these respects, the hockey game apparatus according to the present invention substantially departs from the conventional concepts and designs of the prior art, and in so doing provides an apparatus primarily developed for the purpose of which combines the physical characteristics of hockey with the strategic characteristics of foosball.

SUMMARY OF THE INVENTION

A primary object of the present invention is to provide a hockey game apparatus that will overcome the shortcomings of the prior art devices.

Another object is to provide a hockey game apparatus which combines the physical characteristics of hockey with the strategic characteristics of foosball.

An additional object is to provide a hockey game apparatus that emits a limited amount of noise during play.

Another object is to provide a hockey game apparatus that allows each player to introduce the ball or disk onto the playing surface without having an advantage.

A further object is to provide a hockey game apparatus that reduces the chances that the ball or disk will become trapped during play.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
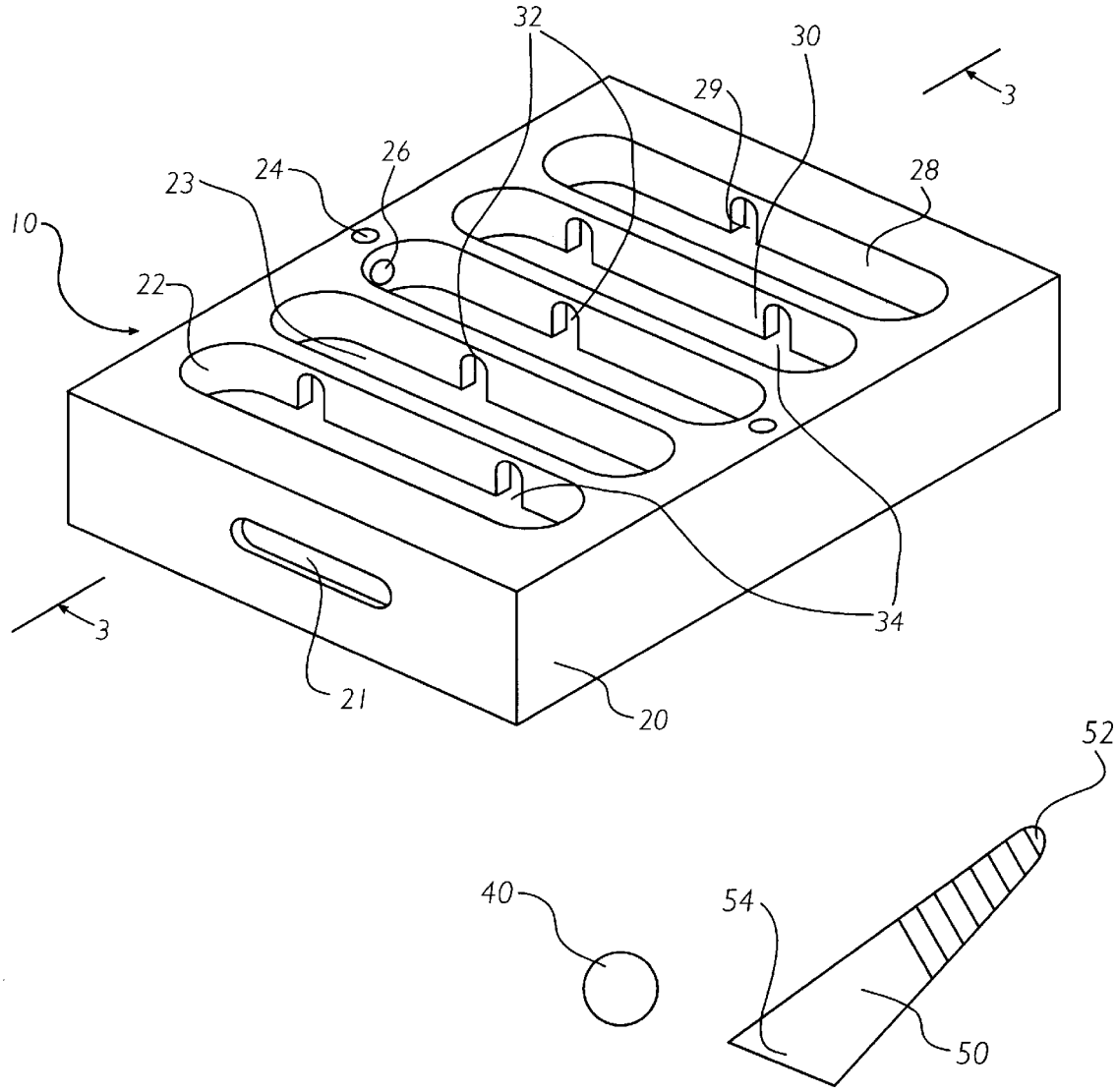
FIG. 1 is an upper perspective view of the present invention along with the paddle and ball.
Figure 2:
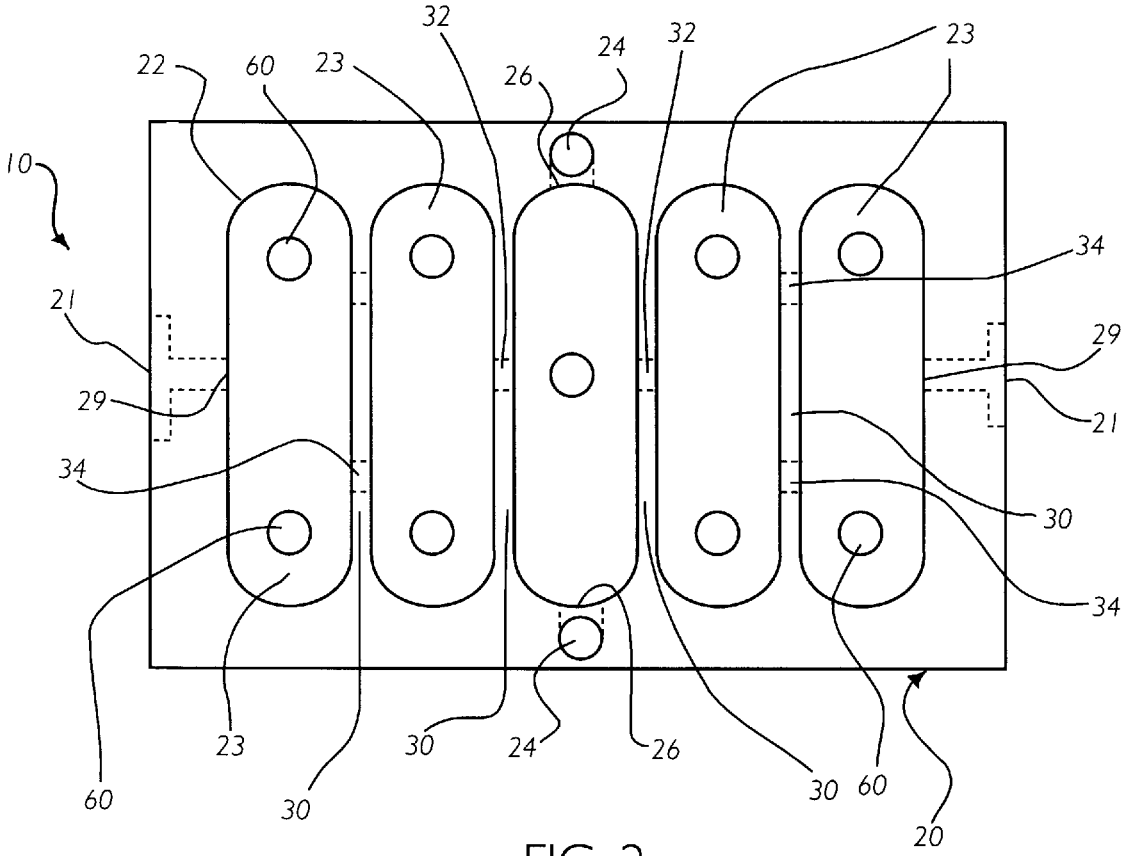
FIG. 2 is a top view of the present invention.
Figure 3:
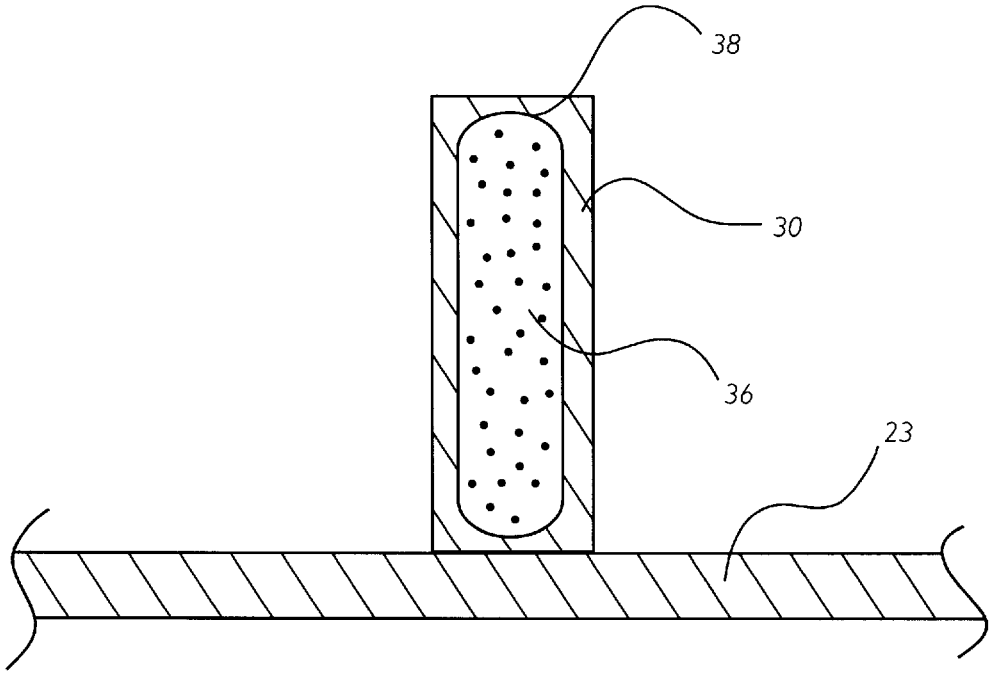
FIG. 3 is a cross sectional view taken along line 3—3 of FIG. 1 of the drawings disclosing the filler within the partition.

Turning now descriptively to the drawings, in which similar reference characters denote similar elements throughout the several view, FIGS. 1 through 3 illustrate a hockey game apparatus 10, which comprises a frame 20 having a floor 23 and a plurality of arcuate walls 22, a pair of opposing goal openings 29, and a plurality of partitions 30 having at least one opening 32, 34. The players each utilize a paddle 50 to engage a ball 40 or disk for scoring a goal in the opposing player's goal opening 29. The partitions 30 and the arcuate walls 22 preferably include a filler 36 of either foam, water or other sound deadening material. The filler 36 within the partitions 30 reduces the amount of sound emitted from engagement by the paddles 50. The arcuate walls 22 reduce the chance that the ball 40 or disk will become trapped within a comer during play. The frame 20 is preferably constructed from wood or similar material.

As best shown in FIG. 1 of the drawings, the frame 20 is substantially rectangular shaped. The frame 20 includes a floor 23 and walls 22, 28 for retaining the ball 40 in play. There are two opposing back walls 28 wherein both have a goal opening 29 within each. Between the two opposing back walls 28 are a plurality of partitions 30 as best shown in FIG. 2 of the drawings. Between each partition 30 is a pair of opposing arcuate walls 22. Preferably, there are four partitions 30, with a center pair and an end pair. Each of the center pair of partitions 30 preferably has only one center opening 32 for allowing the ball 40 to pass through. Each of the end pair of partitions 30 preferably has a pair of side openings 34 for allowing the ball 40 to pass through. The side openings 34 are not in opposition to either the goal openings 29 or the center openings 32 so as to prevent the ball 40 from being directly shot through all of the partitions 30 into a goal opening 29 with only one shot. There are a plurality of face off circles 60 as best shown in FIG. 2 of the drawings.

As best shown in FIGS. 1 and 2 of the drawings, a pair of ball entry openings 24 are within the frame 20 for allowing insertion of the ball 40 which then projects into the play area through either of the ball exit openings 26. If the ball 40 is shot through either of the goal openings 29, the ball 40 is then returned to the player through a ball return opening 21 which is connected to the goal opening 29.

As best shown in FIG. 3 of the drawings, the partitions 30 preferably have a chamber 38 within which is preferably filled with a filler 36. The filler 36 muffles the sound emitted from the paddles 50 engaging the partitions 30 during play. The filler 36 may be any material such as water, gel, foam, sand, fiberglass insulation, or any other sound resistant material. The arcuate walls 22, floor 23, and the back walls 28 preferably include the filler 36 also for reducing the sound emitted during play.

As shown in FIG. 1 of the drawings, the paddle 50 is an elongated member. The paddle 50 has a broad end 54 which engages the ball 40 or disk. A gripping 52 is attached to the end of the paddle 50 opposite of the broad end 54. The gripping 52 allows the user engage the paddle 50 during play without slippage. Additionally, the broad end 54 may be coated with a sound deadening substance such as rubber or plastic.

RULES OF PLAY

The rules of play are relatively simple. The winner of a coin flip chooses which goal opening 29 to defend. The loser of the coin flip enters the ball 40 into play by dropping the ball 40 into the ball entry opening 24 which is projected into play through the ball exit opening. If during play the ball 40 jumps out of the frame 20, the ball 40 is placed back into play by dropping the ball 40 at the closest face off circle 60 where the ball 40 exited. Neither of the two players may block any of the openings 29, 32, 34 with their paddle 50 during play. Additionally, for safety reasons, there is no checking, high sticking or slashing allowed during play. The game can be played either with a set time limit or a desired score limit. The object of the game is to score as many goals as possible in the goal opening 29 of the opposing player.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hockey game apparatus comprising:

a frame having a floor and at least one side wall defining a cavity;

a pair of opposing goals within said at least one side wall;

at least one partition within said cavity of said frame;

at least one opening within said at least one partition;

at least two paddles; and at least one engaging member which is manipulated by said at least two paddles during play, wherein said at least one partition includes:

a chamber; and a filler within said chamber for muffling sound from said at least two paddles engaging said at least one partition.

2. The hockey game apparatus of claim 1, wherein said at least one partition comprises four partitions substantially parallel to one another.

3. The hockey game apparatus of claim 2, wherein said at least one side wall comprises a pair of side walls and a pair of rear walls.

4. The hockey game apparatus of claim 3, wherein said frame includes:

an entry opening for receiving said at least one engaging member; and an exit opening for emitting said at least one engaging member into play within said cavity of said frame.

5. The hockey game apparatus of claim 4, wherein said at least one opening within each of said four partitions are not in opposition to said pair of goals within said frame.

6. The hockey game apparatus of claim 5, including at least one ball return opening connected to said pair of goals.

7. The hockey game apparatus of claim 6, wherein said four partitions comprise a center pair and an end pair, wherein said center pair include one center opening and wherein said end pair include a pair of side openings.

8. The hockey game apparatus of claim 7, wherein said side openings are not in opposition to said pair of goals nor said center openings.

9. The hockey game apparatus of claim 2, wherein said at least one side wall comprises five pairs of opposing arcuate walls and a pair of rear walls, wherein said pair of rear walls includes said pair of goals.

10. The hockey game apparatus of claim 9, wherein said frame includes:

an entry opening for receiving said at least one engaging member; and an exit opening for emitting said at least one engaging member into play within said cavity of said frame.

11. The hockey game apparatus of claim 10, wherein said at least one opening within each of said four partitions are not in opposition to said pair of goals within said frame.

12. The hockey game apparatus of claim 11, including at least one ball return opening connected to said pair of goals.

13. The hockey game apparatus of claim 12, wherein said four partitions comprise a center pair and an end pair, wherein said center pair include one center opening and wherein said end pair include a pair of side openings.

14. The hockey game apparatus of claim 13, wherein said side openings are not in opposition to said pair of goals nor said center openings.

15. The hockey game apparatus of claim 14, wherein said filler is comprised of either water or sand.

16. A method of playing a hockey game apparatus, comprising the steps of:

(a) providing a frame having a floor, side walls, and four partitions between said side walls wherein said partitions include a chamber filled with a filler;

(b) inputting an engaging member;

(c) engaging said engaging member with a pair of paddles;

(d) adding one point for every goal scored; and (e) continuing play until a predetermined score has been reached by one player.

* * * * *